US005289080A

United States Patent [19]

Park

[11] Patent Number: 5,289,080

[45] Date of Patent: Feb. 22, 1994

[54] MASK FRAME DAMPER FOR COLOR CATHODE RAY TUBES

[75] Inventor: Youngki Park, Kyunggi, Rep. of Korea

[73] Assignee: Samsung Electron Devices Co., Ltd., Kyunggi, Rep. of Korea

[21] Appl. No.: 876,946

[22] Filed: May 1, 1992

[30] Foreign Application Priority Data

Aug. 21, 1991 [KR] Rep. of Korea ..... 91-13282

[51] Int. Cl.[5] ..... H01J 29/07

[52] U.S. Cl. ..... 313/402; 313/404

[58] Field of Search ..... 313/402, 405, 406, 407

[56] References Cited

U.S. PATENT DOCUMENTS

| | | | |
|---|---|---|---|
| 3,638,063 | 1/1972 | Tachikawa et al. | 313/348 |
| 4,318,025 | 3/1982 | Penird et al. | 313/404 |
| 4,367,430 | 1/1983 | Matsushita et al. | 313/405 |
| 4,504,764 | 3/1985 | Sakamoto et al. | 313/403 |
| 4,506,188 | 3/1985 | Puhak | 313/405 |
| 4,827,179 | 5/1989 | Adler et al. | 313/402 |
| 4,950,943 | 8/1990 | Ito | 313/404 |

FOREIGN PATENT DOCUMENTS

| | | |
|---|---|---|
| 0207724 | 1/1987 | European Pat. Off. . |
| 2081418 | 2/1982 | United Kingdom . |

*Primary Examiner*—Sandra L. O'Shea

*Attorney, Agent, or Firm*—Christie, Parker & Hale

[57] ABSTRACT

A mask frame damper has a vibration absorbing member installed between a mask frame and a stud pin formed in a panel of a CRT. This member has a mounting part to be fixed on a frame and a first and a second absorption part extending therefrom and each bent at a predetermined angle. A bending joint formed between the first and second absorption part is in contact with a stud pin and the end of the second absorption part is in contact with the mounting part. Balls are installed at the first and second absorption parts. The first and second vibration absorption parts, in one embodiment, are formed by a plate spring with balls having a predetermined weight installed therein.

16 Claims, 1 Drawing Sheet

MASK FRAME DAMPER FOR COLOR CATHODE RAY TUBES

FIELD OF THE INVENTION

The present invention relates to a mask frame damper for color cathode ray tubes (CRTs) and, in particular, to a mask frame damper for minimizing vibrations generated by external impact or speaker howling, so as to obtain good color purity.

BACKGROUND OF THE INVENTION

Color cathode ray tubes has a panel on which triads of phosphors are formed; a funnel which is joined to the panel and is provided with a deflection yoke placed on the funnel's periphery; and a neck which is extended from the funnel and in which an electron gun for emitting electron beams is inserted.

A shadow mask through which the electron beams may pass and be scanned on each phosphor is placed at the inside of a skirt of the panel. This mask can be fixed by a means such as a mask frame. The mask frame is suspended by interposing a hook spring H between a stud pin S placed in panel P as shown in FIG. 3.

This shadow mask is fixed by the mask frame, being joined to its skirt part of the panel by the mask frame at the position where their minute apertures formed on the hole part thereof correspond to the phosphors layered on the inner surface thereof. However, this structure has a disadvantage of reducing color purity. That is, there is no mechanism to damp vibrations generated by external impact or speaker howling. This, due to these vibrations, the apertures formed at the outer surface of the shadow mask supported by the mask frame each do not properly align with the phosphors formed at the inner surface of the plate, so that the electron beams will impact off line thereon which reduces color purity.

To solve this problem, U.S. Pat. No. 3,638,063, issued to Takuji Tachikawa et al on Jan. 25, 1972, proposes a method that a damping wire or a damping rod is installed across a grid member of a CRT, so that the damping rod presses the grid member to prevent vibrations by external impact or other possible impacts.

U.S. Pat. No. 4,504,764 issued to Yasuhiro Sakamoto on Mar. 12, 1985, describes a method for reducing vibrations such that sonorous vibrations marks the sonorous frequency of a grill member of color selecting apertures.

However, the inventor has found that the above-mentioned solutions are not effective when strong vibrations exist, such as can be generated by external impact.

SUMMARY OF THE INVENTION

Accordingly, the present invention is introduced for the purpose of overcoming the problem above of the conventional technology. A feature of the present invention is a mask frame damper for color CRTs which can minimize vibrations even when vibrations generated by strong external impact or speaker howling is transmitted to a mask frame. In one embodiment, a damper in which a vibration absorbing member is installed between a mask frame and a stud pin formed in a panel. Thus, the damper placed therebetween changes vibrations which is applied to the mask frame into friction heat whereby they are extinguished, to prevent color impurity deterioration.

BRIEF DESCRIPTION OF THE DRAWINGS

The present invention will be more apparent from the following detailed description when read in connection with the accompanying drawings, in which.

DETAILED DESCRIPTION OF THE PREFERRED EMBODIMENT

Figure 1:
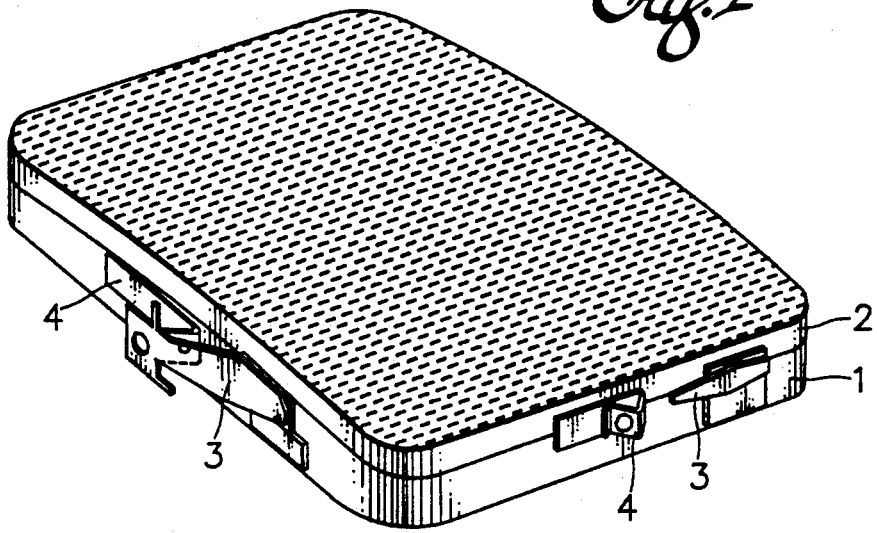
FIG. 1 is a perspective view of a shadow mask frame provided with a mask frame damper of the present invention.

FIG. 1 illustrates a mask frame provided with a damper of the present invention. As shown in this figure, the frame 1 and a shadow mask 2 are attached and united to each other by laser or resistance welding. At the side of frame 1, a mounting element such as spring 3 for connection to another mounting element such as a stud pin for fixing fame 1 to the inside of a panel 3 (FIGS. 2 and 4) is attached thereto by welding.

At the inside of hook spring 3 for connection to the stud pin, vibration absorbing element 4 is interposed therein and fixed to the side of the frame. An elongate member such as a plate spring which has the best absorption force is preferably used as such an element 4.

Figure 4:
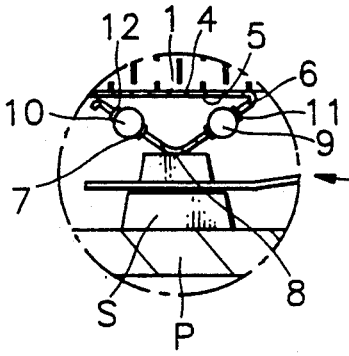
FIG. 4 is a blow-up of a portion of FIG. 2 as indicated therein.
Figure 2:
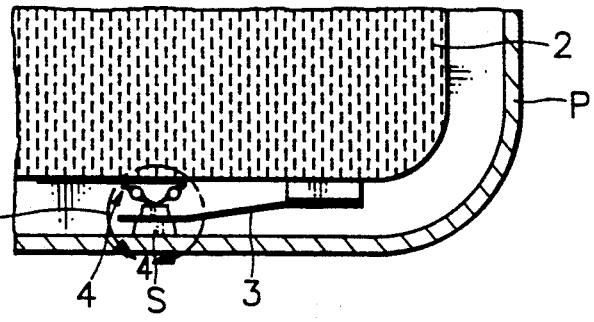
FIG. 2 is a partial section view of assembly of a damper of the present invention.
Figure 3:
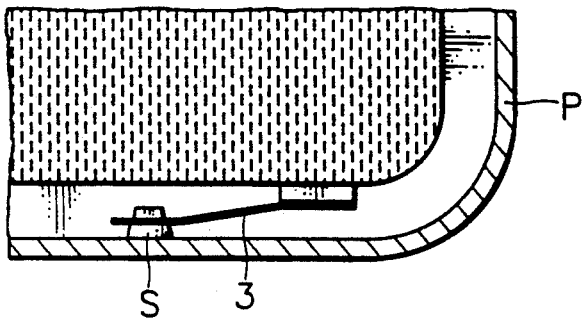
Fig. 3 PRIOR ART
FIG. 3 is a partial section view of a conventional mask frame structure.

As shown in FIGS. 2 and 4, the plate spring has a base 5, a first shock absorption part 6 and a second shock absorption part 7.

The first absorption part 6 is bent at a predetermined angle to base 5 and the second absorption part 7 connected to the end of first absorption part 6 is bent in the opposite direction of the first absorption part 6 whereby the whole shape formed therefrom is that or substantially that of a triangle.

The end of second absorption part 7 is elastically contacted with the surface of base 5. A bending joint 8 between absorption parts 6,7 is in contact with the surface of stud pin S.

At absorption parts 6,7, balls 9,10 which have a predetermined weight are respectively installed. Holes are formed absorption parts 6,7 and flanges 11,12 are outwardly formed around these holes to seat and fix these balls 9,10 therein.

While the flanges are used for seating the ball in this embodiment of the present invention, these balls can be attached by welding or by installing a ball mounting pin at the center of the ball.

A mechanism for mounting each ball can be changed into other kinds of shapes within the range of the technical idea of the present invention.

The mask frame damper of the present invention is operated as follows. When the frame vibrates due to external impact or speaker howling, the vibrations is transmitted to the first absorption part 6 of element 4. Thus, the force transmitted therefrom is changed friction heat by friction created between the banding part 8 and the stud pin S whereby vibrations can be initially reduced or extinguished.

Any remaining vibrations are transmitted to the second absorption part 7 and friction heat is generated by friction between the end of part 7 and mounting part 5, whereby they can be further reduced or extinguished.

At the same time as vibration damping such as the above occurs, vibrations is transmitted to balls 9,10, which vibrations are restrained by inertia generated by weight of the balls.

Thus, the mask frame damper of the present invention can reduce and even extinguish vibrations, by the above three steps or stages such as the above, so that even when applying comparatively strong vibrations, the damper can minimize vibrations of the mask frame to prevent color purity deterioration to obtain good color purity.

I claim:

1. In a cathode ray tube having an electron gun, a display panel receiving electrons from the gun, a shadow mask, a mask frame for supporting the shadow mask, and means for fixing the mask frame in position with respect to the panel, including a first mounting element fixed to the panel and a second mounting element extending from the mask frame, the improvement wherein damping means for absorbing vibrations is disposed between the mask frame and the first mounting element, wherein the damping means comprises an elongate element including a base fixed to the mask frame, a first shock absorption part extending from the base, a second shock absorption part extending from the first shock absorption part, and a first ball and a second ball installed on the first and second absorption parts, respectively.

2. The cathode ray tube as claimed in claim 1, wherein the damping means comprises a free end corresponding to an end of the second shock absorption part remote from the first shock absorption part.

3. The cathode ray tube as claimed in claim 2, wherein the first and second absorption parts are formed by bending the elongate element into a triangular shape.

4. The cathode ray tube as claimed in claim 1, wherein the first and second shock absorption parts define a bending joint therebetween, and the bending joint is disposed in contact with the first mounting element.

5. The cathode ray tube as claimed in claim 4, wherein the first mounting element is a stud pin.

6. The cathode ray tube as claimed in claim 5, wherein the second mounting element is a hook spring fixed to the mask frame at one end and the stud pin at the other end.

7. The cathode ray tube as claimed in claim 2, wherein the first and second shock absorption parts define a bending joint therebetween, and the bending joint is disposed in contact with the first mounting element.

8. The cathode ray tube as claimed in claim 3, wherein the first and second shock absorption parts defined a bending joint therebetween, and the bending joint is disposed in contact with the first mounting element.

9. The cathode ray tube as claimed in claim 1, wherein an end of the second absorption part is in contact with the base.

10. The cathode ray tube as claimed in claim 3, wherein an end of the second absorption part is in contact with the base.

11. The cathode ray tube as claimed in claim 1, wherein the damping means is a plate spring.

12. A damping element for minimizing vibrations between a display panel and a mask frame attached to the panel for supporting a shadow mask in position with respect to the panel, the damping element comprising a vibration-absorbing member fixed to the mask frame and in contact with a mounting element fixed to the panel for attaching the mask frame to the panel, wherein the vibration-absorbing member comprises an elongate member having a base fixed to the frame, a first absorption part extending from the base, a second absorption part extending from the first absorption part, and first and second balls installed on the first and second absorption parts, respectively.

13. The damping element as claimed in claim 12, wherein the base and the first second absorption parts are formed by bending the elongate member into a triangular shape.

14. The damping element as claimed in claim 12, wherein there is a bending joint between the first and second absorption parts which is in contact with the mounting element.

15. The damping element as claimed in claim 12, wherein an end of the second absorption part is in contact with the base.

16. The damping element as claimed in claim 12, wherein the vibration-absorbing member is a plate spring.

* * * * *